US005859491A

United States Patent [19]

Nishikawa et al.

[11] Patent Number: 5,859,491

[45] Date of Patent: Jan. 12, 1999

[54] SPARK PLUG

[75] Inventors: Kenichi Nishikawa; Makoto Sugimoto, both of Aichi, Japan

[73] Assignee: NGK Spark Plug Co., Ltd., Japan

[21] Appl. No.: 783,115

[22] Filed: Jan. 14, 1997

[30] Foreign Application Priority Data

| | | | |
|---|---|---|---|
| Jan. 31, 1996 | [JP] | Japan | 8-015725 |
| Aug. 19, 1996 | [JP] | Japan | 8-217007 |
| Oct. 22, 1996 | [JP] | Japan | 8-279099 |

[51] Int. Cl.[6] ..... H01T 13/20; H01T 13/00; F02M 57/06; F02P 13/00

[52] U.S. Cl. ..... 313/141; 513/118; 106/48

[58] Field of Search ..... 313/118, 130, 313/131 E, 131 A, 137, 141, 143, 144; 106/48; 428/432; 501/14; 123/169 EI, 169 E, 169 P

[56] References Cited

U.S. PATENT DOCUMENTS

| | | | |
|---|---|---|---|
| 4,084,976 | 4/1978 | Hinton | 313/118 X |
| 4,120,733 | 10/1978 | Knapp | 106/48 |
| 4,256,497 | 3/1981 | Knapp | 106/48 |
| 4,746,578 | 5/1988 | Kondo et al. | 428/432 |
| 5,518,968 | 5/1996 | Knapp | 501/14 |

*Primary Examiner*—Sandra O'Shea
*Assistant Examiner*—Mack Haynes
*Attorney, Agent, or Firm*—Brinks Hofer Gilson & Lione

[57] ABSTRACT

A spark plug for an internal combustion engine. The spark plug includes an insulator coated with glaze in an area extending from a head portion to a trunk portion of the insulator. Preferably, the glaze is prepared from $B_2O_3$—$SiO_2$ glass containing two or more oxides selected from the group consisting of $Al_2O_3$, $Na_2O$, CaO, ZnO, BaO, $Li_2O$ and $Bi_2O_3$. The glaze is prepared by dry-mixing a plurality of powder materials, melting the resultant mixture in water for vitrification, wet-powdering the resultant vitrification, and adding an organic binder to the resultant powder. The glaze is applied to the insulater and fired at a glost temperature of not more than 1150° C. The Pb content of the glaze is not more than 10 wt. % in terms of PbO. Accordingly, even when a strong electric field is induced at the trunk portion of the insulator, the conversion of Pb to conductive substances is very little or zero. As a result, the flashover voltage between the terminal electrode and the metallic shell of the spark plug is less likely to decrease, thus preventing a spark failure of the spark plug.

20 Claims, 3 Drawing Sheets

SPARK PLUG

BACKGROUND OF THE INVENTION

1. Field of the Invention

The present invention relates to a spark plug to be installed in an internal combustion engine.

2. Description of the Related Art

Conventionally, in order to prevent flashover between a terminal connected to a terminal electrode and a metallic shell, the surface of an insulator has been coated with glaze in an area extending from the head portion to the trunk portion of the insulator.

Since glost firing has been performed at a temperature between 900° C. and 1100° C., there has been glaze whose Pb content is equal to or greater than 20 wt. % in terms of PbO (PbO contributes toward a decrease in glost firing temperature).

The present inventors have found that when a corona discharge occurs on the exposed portion (the surface of a head portion not covered with a plug cap) of an insulator, glaze discolors to red or reddish yellow, and the flashover voltage of a spark plug reduces.

As a result of investigation, the inventors have identified the cause of this discoloration and the accompanying reduction in the flashover voltage, as described below.

In an ordinary traveling state (city driving or highway driving), there arises no problem with a spark plug having an insulator coated with glaze whose Pb content is rather high at 20 wt. % to 40 wt. % in terms of PbO. However, during travel over a long period of time under special conditions, such as along a road having many uphill and downhill sections, a strong electric field is induced, mainly on the trunk portion of an insulator in the vicinity of the caulked portion of a metallic shell, resulting in the occurrence of a corona discharge. Energy of the corona discharge causes Pb contained in glaze to change the $Pb_3O_4$ (red) or $Pb_2O_3$ (reddish yellow) and causes the insulation resistance of the insulator to decrease drastically.

As a result, there is a reduction in the flashover voltage between the terminal electrode and the metallic shell, resulting in a high likelihood of the occurrence of flashover.

SUMMARY OF THE INVENTION

An object of the present invention is to solve the above-mentioned problem involved in the conventional spark plug, and to provide a spark plug which prevents a reduction in the flashover voltage between a terminal connected to a terminal electrode and a metallic shell so as to attain lower likelihood of the occurrence of flashover.

The present invention provides a spark plug in which the surface of an insulator is coated with glaze in an area extending from a head portion to a trunk portion of the insulator, wherein the Pb content of the glaze is not more than 10 wt. % in terms of PbO.

The present invention also provides a spark plug in which a glaze, which has been prepared by a process comprising the steps of dry-mixing a plurality of powder materials for the glaze, melting the resultant mixture at a high temperature, quenching the molten mixture in water for vitrification, wet-powdering the resultant vitrification, and adding an organic binder to the resultant powder, is applied to the surface of an insulator in an area extending from a head portion to a trunk portion of the insulator and is fired at a glost firing temperature to form a coating layer of the glaze, wherein the Pb content of the glaze is not more than 10 wt. % in terms of PbO.

The present invention further provides a spark plug composed of a cylindrical metallic shell having a ground electrode, an insulator whose surface is coated with glaze in an area extending from a head portion to a trunk portion and which is fixed within the metallic shell, and a center electrode fixed in the axial bore of the insulator, wherein the Pb content of the glaze is not more than 10 wt. % in terms of PbO.

Preferably, the glaze is prepared from $B_2O_3$—$SiO_2$ glass containing two or more oxides selected from the group consisting of $Al_2O_3$, $Na_2O$, CaO, ZnO, BaO, $Li_2O$ and $Bi_2O_3$.

More preferably, the glaze contains 49.1–64.5 wt. % of $SiO_2$, 5.0–25.0 wt. % of $B_2O_3$, 0–10.1 wt. % of $Al_2O_3$, 0–7.4 wt. % of $Na_2O$, 0–5.5 wt. % of CaO, and 0–10.2 wt. % of ZnO.

In the spark plug of the invention, the surface of the insulator is coated with glaze in the area extending from the head portion to the trunk portion of the insulator, and the Pb content of the glaze is set to be equal to or less than 10 wt. % in terms of PbO. Accordingly, even when a strong electric field is induced at the trunk portion of the insulator with the resultant occurrence of a corona discharge, the conversion of Pb to conductive substances, such as $Pb_3O_4$ and $Pb_2O_3$, is zero (when the Pb content is zero) or very little.

Accordingly, the flashover voltage between the terminal electrode and the metallic shell is less likely to decrease, thus preventing a spark failure of the spark plug.

These and other aspects and advantages of the invention are described or apparent from the following detailed description of the preferred embodiments and appended drawings wherein like reference numbers refer to the same element, feature or component.

BRIEF DESCRIPTION OF THE DRAWINGS

The preferred embodiments are described with reference to the drawings in which.

DETAILED DESCRIPTION OF THE PREFERRED EMBODIMENTS

Embodiments of the present invention will be described with reference to FIGS. 1 to 3.

Figure 1:
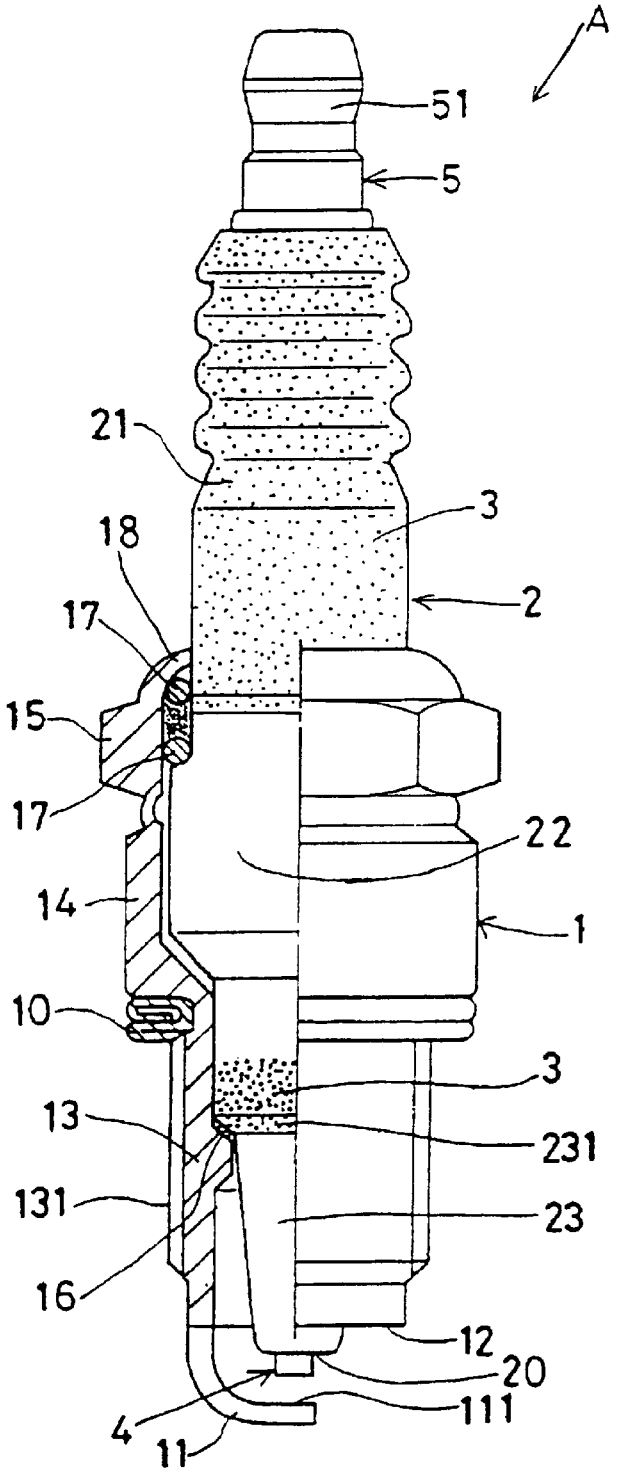
FIG. 1 is a partially sectioned view of a spark plug according to an embodiment of the present invention.

As shown in FIG. 1, a spark plug A is composed of a cylindrical metallic shell 1 having a ground electrode 11 which projects from a tip end 12, an insulator 2 whose surface is coated with a glaze 3 and which is fixed within the metallic shell 1, and a center electrode 4 fixed within an axial bore 20 formed in the insulator 2. The spark plug A is attached to a cylinder head (not shown) of an internal combustion engine.

The metallic shell 1 is formed of low-carbon steel and includes a threaded portion 13 on which external threads 131 are formed; a barrel portion 14 having a thin-walled portion formed at the rear end thereof; and a hexagonal portion 15 to which a plug wrench is to be fit. A gasket 10 is disposed on the front side of the barrel portion 14. Numeral 16 denotes a packing, and numeral 17 denotes a ring.

The substantially L-shaped ground electrode 11 is disposed such that its discharge surface 111 faces the end surface of the center electrode 4. The ground electrode 11 is formed of a nickel alloy and includes a copper core, which has good heat conductivity.

The insulator 2 is formed by sintered alumina-based ceramic and includes a corrugated head portion 21, a trunk portion 22 which is located in a space formed by the hexagonal portion 15 and the barrel portion 14 of the metallic shell 1, and a leg portion 23 which is located in a space formed by the threaded portion 13 of the metallic shell 1.

The glaze 3, whose Pb content is 0 wt. % to 10 wt. % in terms of PbO, covers the surface of the insulator 2 in an area extending from the head portion 21 to the trunk portion 22, and in area corresponding to a leg base portion 231.

The center electrode 4 is formed of a nickel alloy and includes a copper core, which has good heat conductivity, and is fit into the axial bore 20 such that the end portion thereof projects from the front end of the insulator 2 and such that the other end portion is sealed within the axial bore 20 through the use of seal glass (not shown). The center electrode 4 is electrically connected to a terminal electrode 5 via the seal glass.

The terminal electrode 5 is formed of low carbon steel. The seal portion of the terminal electrode 5 is glass-sealed within the axial bore 20 of the insulator 2, and a terminal portion 51 of the terminal electrode 5 projects from the end surface of the head portion 21 of the insulator 2. A plug cap (not shown) is fit onto the terminal portion 51 and the rear end section of the head portion 21.

Next will be described the method of manufacturing the spark plug A (primarily the method of coating with the glaze 3).

(1) At least two or more oxides selected from the group consisting of $Al_2O_3$, $Na_2O$, CaO, ZnO, $Li_2O$, $Bi_2O_3$, BaO, and PbO are added into $B_2O_3$—$SiO_2$ base glass at predetermined proportions and then mixed.

(2) The resultant mixture is placed into a crucible, and then melted at a temperature of 1400° C. within a furnace.

(3) The molten mixture is water-quenched, and the resultant solid is wet-pulverized within the crucible. An organic binder is added to the resultant powder in an amount of about 2 wt. %, to thereby obtain glaze slurry.

(4) The thus prepared glaze slurry is sprayed onto the surface of the insulator 2 to cover an area extending from the head portion 21 to the trunk portion 22, and an area corresponding the leg base portion 231.

(5) The insulator 2 is fired for about 10 minutes at a glost firing temperature corresponding to an applied glaze (see Table 2). Subsequently, the insulator 2 undergoes visual appearance inspection.

Table 1 shows the analyzed composition of various kinds of the glaze 3 fired at the respective glost firing temperatures. The Pb content of glazes No. 1 to No. 3 and No. 7 to No. 10 is not more than 10 wt. % in terms of PbO.

TABLE 1

| | Glaze No. | | | | | | | | | |
|---|---|---|---|---|---|---|---|---|---|---|
| Composition | 1 | 2 | 3 | 4 | 5 | 6 | 7 | 8 | 9 | 10 |
| $SiO_2$ | 55.4 | 49.1 | 49.2 | 51.3 | 44.7 | 59.2 | 62.3 | 62.3 | 57.5 | 64.5 |
| $B_2O_3$ | 19.3 | 20.2 | 15.2 | 16.2 | 10.3 | 4.8 | 17.0 | 17.0 | 5.0 | 25.0 |
| $Al_2O_3$ | 7.8 | 10.1 | 9.8 | 4.6 | 5.1 | 2.3 | 7.0 | 7.0 | 2.5 | — |
| $Na_2O$ | 7.4 | 5.1 | 3.8 | 1.3 | 1.7 | — | 5.1 | — | 1.5 | 5.0 |
| CaO | 2.3 | — | 2.5 | 3.0 | 3.3 | — | 4.6 | 4.6 | 4.0 | 5.5 |
| ZnO | 7.8 | 10.2 | 9.7 | 11.3 | 9.7 | 3.1 | — | — | — | — |
| BaO | — | — | — | — | — | — | 4.0 | 4.0 | — | — |
| $Li_2O$ | — | — | — | — | — | — | — | 5.1 | — | — |
| $Bi_2O_3$ | — | — | — | — | — | — | — | — | 29.5 | — |
| PbO | — | 5.3 | 9.8 | 12.3 | 25.2 | 30.6 | — | — | — | — |

(6) The insulator 2 is fixed such that the leg portion 23 faces downward. The center electrode 4 is inserted into the axial bore 20 from the side of the head portion 21. Then, conductive powder glass for glass seal and resistance powder are placed into the axial bore 20. Finally, the terminal electrode 5 is inserted into the axial bore 20.

(7) The insulator 2 is heated to a temperature of 800° C. to 950° C. so as to melt powder glass, and a downward force is applied to the terminal portion 51 of the terminal electrode 5.

(8) The insulator 2 is cooled naturally so as to solidify the molten glass, thereby completing glass seal.

(9) The glass sealed insulator 2 is fit into the metallic shell 1. A thin-walled portion of a caulked portion 18 of the metallic shell 1 is caulked, thereby fixedly attaching the insulator 2 into the metallic shell 1. Thus, the spark plug A is completed.

Table 2 shows test results of spark plugs which are respectively coated with glazes No. 1 to No. 10 listed in Table 1. The test results include appearance color observed immediately after glost firing, insulation resistance under heated condition, appearance color observed after engine test, flashover voltage, and evaluation.

TABLE 2

| Composition | Glaze No. 1 | 2 | 3 | 4 | 5 | 6 | 7 | 8 | 9 | 10 |
|---|---|---|---|---|---|---|---|---|---|---|
| Glost firing temp. (°C.) | 1150 | 1100 | 1100 | 1000 | 950 | 950 | 950 | 950 | 900 | 950 |
| Color immediately after glost firing | AA | AA | AA | AA | AA | AA | AA | AA | AA | AA |
| Insulation resistance under heated condition (MΩ) | 150 | 200 | 250 | 800 | 700 | 200 | 150 | 130 | 200 | 150 |
| Color after engine test | AA | AA | BB | CC | CC | DD | AA | AA | AA | AA |
| Flashover voltage (kV) | >35 | >35 | >35 | 33 | 30 | 27 | >35 | >35 | >35 | >35 |
| Evaluation | O | O | O | X | X | X | O | O | O | O |

Note:
AA . . . colorless transparent
BB . . . yellow
CC . . . reddish brown
DD . . . red
O . . . pass
X . . . fail The insulation resistance of the spark plug A under heated condition appearing in Table 2 was measured in the following manner.

Figure 2:
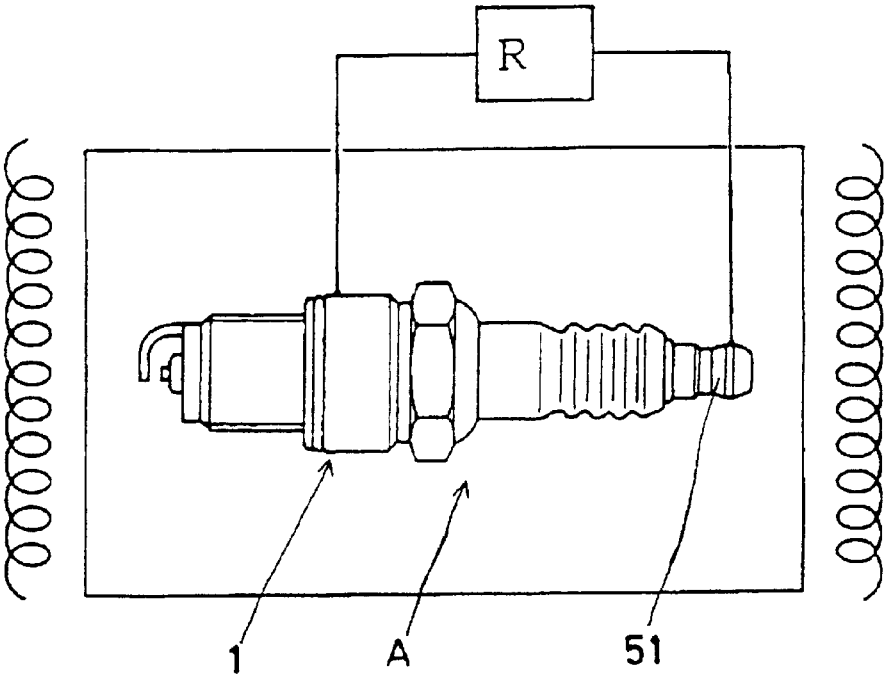
FIG. 2 is an explanatory diagram showing a test equipment for measuring an insulation resistance of a spark plug in a heated state.

As shown in FIG. 2, the spark plug A coated with each of the glazes listed in Table 1 was hung within a constant-temperature oven regulated to a temperature of 500° C.±10° C. After the spark plug A was thus-headed for 30 minutes, the resistance between the terminal portion 51 and the metallic shell 1 was measured using a megohmmeter which applies 1000 VDC.

As the alkali component ($Na_2O$, $Li_2O$, etc.) content in the glaze 3 increases, the insulation resistance under heated condition reduces. However, measurements of the above-described test revealed that the alkali component content in the glaze 3 did not cause a reduction in flashover voltage.

For example, for the spark plugs A which are respectively coated with glazes No. 1, No. 2, No. 7, No. 8, and No. 10 whose $Na_2O$ or $Li_2O$ content is relatively high, the insulation resistance under heated condition is in a relatively low range of 130 to 200 MΩ, but the flashover voltage exceeds 35 kV.

On the other hand, for the spark plugs A which are respectively coated with glazes No. 4 and No. 5, the insulation resistance under heated condition is relatively high, i.e., 800 MΩ and 700 MΩ, respectively, but the flashover voltage is relatively low, i.e., 33 and 30 kV, respectively, because the insulation resistance under heated condition reduces to tens of megohms after an engine test, which will be described later.

The engine test appearing in Table 2 was conducted in the following manner.

The spark plug A coated with glaze listed in Table 1 was installed in a 250 cc single-cylinder 4-cycle engine. The engine was continuously run for 100 hours at 6500 rpm in the full-throttle state. The temperature of the insulator 2 (in an area extending from the head portion 21 to the trunk portion 22) was 100° to 150° C.

In the spark plugs A which are respectively coated, at the head portion 21 and the portion between the head portion 21 and the trunk portion 22, with glazes No. 4 to No. 6 whose Pb content exceeds 10 wt. % in terms of PbO, a strong electric field was induced at the section of the trunk portion 22 located in the vicinity of the caulked portion 18 of the metallic shell 1 due to a high voltage applied during the engine test, resulting in a frequent occurrence of corona discharge. The energy of this corona discharge caused Pb contained in the glaze 3 to change to $Pb_3O_4$ (red) or $Pb_2O_3$ (reddish yellow), indicating a reduction in insulation resistance.

Consequently, as will be described below, the flashover voltage between the terminal electrode 5 and the metallic shall 1 becomes equal to less than 35 kV.

The flashover voltage appearing in Table 2 was measured using the following test equipment.

Figure 3:
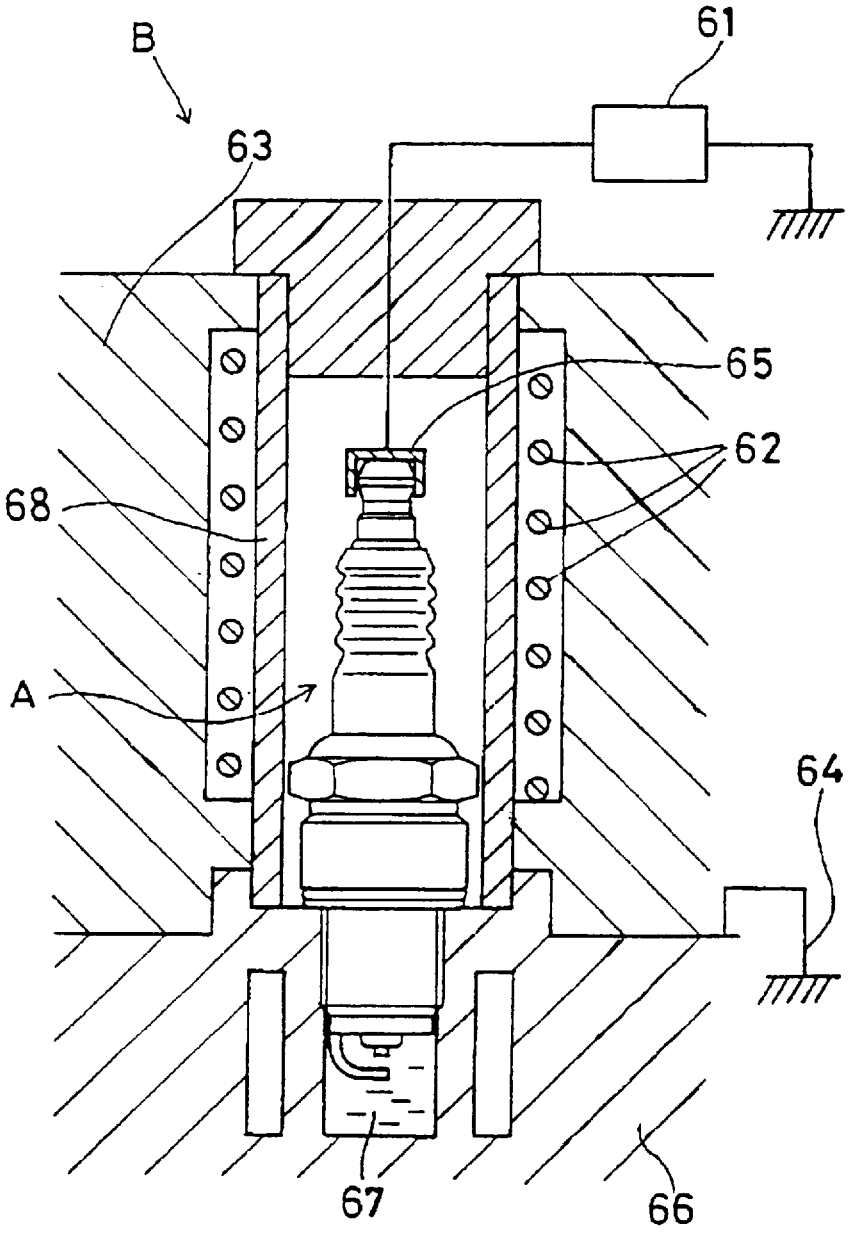
FIG. 3 is an explanatory diagram showing a flashover test equipment.

Each of the spark plugs A which had undergone the engine test was set in a test apparatus B having the structure shown in FIG. 3. After the spark plug A was maintained at a temperature of 150° C. for 1 hour, a direct-current impulse voltage was applied thereto in the following manner: initially a voltage of 20 kV was applied, and then an applied voltage was increased 1 kV by 1 kV at one-minute intervals. When a flashover occurred 3 times or more within one minute at a certain applied voltage, the voltage was taken as the flashover voltage.

In FIG. 3, numeral 61 denotes a direct-current impulse power source, numeral 62 denotes a heating coil for heating the atmosphere of the spark plug A to a temperature of 150° C., numeral 63 denotes a heating chamber, numeral 64 denotes grounding, numeral 65 denotes a terminal fixture, numeral 66 denotes a chamber having a water-cooling jacket, numeral 67 denotes an insulation oil (silicone oil), and numeral 68 denotes an insulating protection tube.

In practical use, the maximum value of a voltage to induce spark across a spark gap is 35 kV. Accordingly, if the flashover voltage is not more than 35 kV, a spark may fail to occur across the spark gap. This is why glazes No. 4 to No. 6 are evaluated as "fail" (X) in Table 2.

The present invention provides the following advantages.

(a) In the spark plugs A which are respectively coated, at the head portion 21 and the portion between the head portion 21 and the trunk portion 22, with glazes No. 1 to No. 3 and No. 7 to No. 10 whose Pb content is not more than 10 wt. % in terms of PbO, the flashover voltage as measured between the terminal 51 of the terminal electrode and the metallic shell 1 exceeds 35 kV, as shown in Table 2.

Thus, the spark plugs A which are respectively coated with glazes No. 1 to No. 3 and No. 7 to No. 10 provide a sufficiently high flashover voltage, thereby preventing the occurrence of a spark failure stemming from flashover.

(b) A method of manufacturing a glaze slurry, a method of applying the glaze slurry to the insulator surface, and a glost firing temperature are substantially similar to conventional ones. Accordingly, the present invention does not require a manufacturer to modify tools and manufacturing apparatuses in order to embody the invention.

(c) When the Pb content of the glaze 3 is not more than 10 wt. % in terms of PbO, the glost firing temperature must be increased. However, it can be made not more than 1150° C. through adjustment of $SiO_2$, $B_2O_3$, $Al_2O_3$, $Na_2O$, CaO, $Li_2O$, $Bi_2O_3$, ZnO, and BaO contents, thereby avoiding an adverse effect (a reduction of strength of the insulator 2 or the like) which would otherwise arise.

The present invention may also be embodied in the following manner:

a. In the above-described embodiments, in order to prevent the occurrence of flashover on the side of the leg portion 23, the leg base portion 231 is coated with the glaze 3. However, the leg base portion 231 may not be coated with the glaze 3.

The glaze 3 applied to the leg base portion 231 improves the conformability with the packing 16 placed on a stepped portion of the metallic shell 1, thereby improving airtightness.

b. If the Pb content of the glaze 3 is not more than 10 wt. % in terms of PbO and the glost firing temperature is not more than 1150° C., a fluoride, such as NaF and $AlF_3$, may be added to the glass material of Table 1.

While this invention has been described in conjunction with specific embodiments, it is evident that many alternatives, modifications and variations will be apparent to those skilled in the art. Accordingly, the preferred embodiments of the invention as set forth herein are intended to be illustrative, rather than limiting. Various changes may be made without departing from the spirit and scope of the invention as defined in the following claims.

What is claimed is:

1. A spark plug, comprising:

a cylindrical metallic shell having a ground electrode;

an insulator fixed within said metallic shell, said insulator having a coating of glaze on an outer surface extending from a head portion to a trunk portion of said insulator; and a center electrode fixed in an axial bore formed in said insulator, wherein the Pb content of said glaze is not more than 10 wt. % in terms of PbO and said glaze contains 49.1–64.5 wt % of $SiO_2$, 5.0–15.0 wt. % of $B_2O_3$, 10.5–55.9 total wt. % of two or more oxides selected from a group consisting of $Al_2O_3$, $Na_2O$, CaO, ZnO, BaO, $Li_2O$, and $Bi_2O_3$.

2. A spark plug according to claim 1, wherein said glaze also coats the outer surface of a leg base portion of said insulator.

3. A spark plug according to claim 1, wherein said glaze is heated at a glost temperature of no more than 1150° C.

4. A spark plug according to claim 1, wherein a flashover voltage of said spark plug is at least 35 kV.

5. A spark plug, comprising:

a cylindrical metallic shell having aground electrode;

an insulator fixed within said metallic shell, said insulator having a coating of glaze on an outer surface extending from a head portion to a trunk portion of said insulator; and a center electrode fixed in an axial bore formed in said insulator, wherein the Pb content of said glaze is not more than 10 wt. % in terms of PbO and said glaze contains 49.1–64.5 wt. % of $SiO_2$, 5.0–15.0 wt. % of $B_2O_3$, 0–10.1 wt. % $Al_2O_3$, 0–7.4 wt. % $Na_2O$, 0–5.5 wt. % CaO, and 0–10.2 wt. % ZnO.

6. A spark plug according to claim 5, wherein said glaze is heated at a glost temperature of no more than 1150° C.

7. A spark plug according to claim 5, wherein said glaze also coats the outer space of a leg base portion of said insulator.

8. A spark plug according to claim 5, wherein a flashover voltage of said spark plug is at least 35 kV.

9. A spark plug, comprising:

a cylindrical metallic shell having a ground electrode an insulator fixed within said metallic shell, said insulator having a coating of glaze on an outer surface extending from a head portion to a trunk portion of said insulator; and a center electrode fixed in an axial bore formed in said insulator, wherein the Pb content of said glaze is not more than 10 wt. % in terms of PbO and said glaze contains 55–64.5 wt. % of $SiO_2$, 5.0–25.0 wt. % of $B_2O_3$, 10.5–55.9 total wt. % of two or more oxides selected from a group consisting of $Al_2O_3$, $Na_2O$, CaO, ZnO, BaO, $Li_2O$, and $Bi_2O_3$.

10. A spark plug according to claim 9, wherein said glaze also coats the outer surface of a leg base portion of said insulator.

11. A spark plug according to claim 9, wherein said glaze is heated at a glost temperature of no more than 1150° C.

12. A spark plug according to claim 9, wherein a flashover voltage of said spark plug is at least 35 kV.

13. A spark plug, comprising:

a cylindrical metallic shell having aground electrode;

an insulator fixed within said metallic shell, said insulator having a coating of glaze on an outer surface extending from a head portion to a trunk portion of said insulator; and a center electrode fixed in an axial bore formed in said insulator, wherein the Pb content of said glaze is not more than 10 wt. % in terms of PbO and said glaze contains 55.0–64.5 wt. % of $SiO_2$, 5.0–25.0 wt. % of $B_2O_3$, 0–10.1 wt. % $Al_2O_3$, 0–7.4 wt. % $Na_2O$, 0–5.5 wt. % CaO, and 0–10.2 wt. % ZnO.

14. A spark plug according to claim 13, wherein said glaze also coats the outer surface of a leg base portion of said insulator.

15. A spark plug according to claim 13, wherein said glaze is heated at a glost temperature of no more than 1150° C.

16. A spark plug according to claim 13, wherein a flashover voltage of said spark plug is at least 35 kV.

17. A spark plug, comprising:

a cylindrical metallic shell having aground electrode;

an insulator fixed within said metallic shell, said insulator having a coating of glaze on an outer surface extending from a head portion to a trunk portion of said insulator; and a center electrode fixed in an axial bore formed in said insulator, wherein the Pb content of said glaze is not more than 10 wt. % in terms of PbO and said glaze contains 49.1–64.5 wt. % of $SiO_2$, 5.0–25.0 wt. % of $B_2O_3$, 0–6.0 wt. % $Al_2O_3$, 0–7.4 wt. % $Na_2O$, 0–5.5 wt. % CaO, and 0–10.2 wt. % ZnO.

18. A spark plug according to claim 17, wherein said glaze also coats the outer surface of a leg base portion of said insulator.

19. A spark plug according to claim 17, wherein said glaze is heated at a glost temperature of no more than 1150° C.

20. A spark plug according to claim 17, wherein a flashover voltage of said spark plug is at least 35 kV.

* * * * *